US007624970B2

(12) United States Patent
Johansson et al.

(10) Patent No.: US 7,624,970 B2
(45) Date of Patent: Dec. 1, 2009

(54) METHOD FOR THE ABSORPTION OF A GAS IN A LIQUID AND AN APPARATUS FOR THIS

(75) Inventors: Robert Johansson, Skellefteå (SE); Yngve Lundgren, Skellefteå (SE); Sam Marklund, Skellefteå (SE)

(73) Assignee: Outotec Oyj, Espoo (FI)

( * ) Notice: Subject to any disclaimer, the term of this patent is extended or adjusted under 35 U.S.C. 154(b) by 539 days.

(21) Appl. No.: 10/583,119

(22) PCT Filed: Dec. 16, 2004

(86) PCT No.: PCT/FI2004/000767

§ 371 (c)(1),
(2), (4) Date: Jun. 16, 2006

(87) PCT Pub. No.: WO2005/058466

PCT Pub. Date: Jun. 30, 2005

(65) Prior Publication Data

US 2008/0006154 A1 Jan. 10, 2008

(30) Foreign Application Priority Data

Dec. 17, 2003 (SE) ..... 0303390

(51) Int. Cl.
*B01F 3/04* (2006.01)

(52) U.S. Cl. ..... 261/79.2; 210/754

(58) Field of Classification Search ..... 261/62, 261/65, 79.2; 210/754; 422/37
See application file for complete search history.

(56) References Cited

U.S. PATENT DOCUMENTS 818,891 A * 4/1906 Jones et al. ..... 165/113

(Continued)

FOREIGN PATENT DOCUMENTS

JP 10286446 A 10/1998

(Continued)

OTHER PUBLICATIONS

International Search Report dated Apr. 14, 2005 for International Application No. PCT/FI2004/000767.

*Primary Examiner*—Scott Bushey
(74) *Attorney, Agent, or Firm*—Buchanan Ingersoll & Rooney PC

(57) ABSTRACT

A process for producing a solution of a gas in a liquid in which the gas is soluble, the solution having a predetermined concentration up to saturation. The gas and the liquid are brought together under controlled supply in a proportion corresponding to the predetermined concentration of the solution, and the gas and the liquid are caused to form a stream passing through a common conduit. The gas and the liquid in the stream are caused to intermix under the action of gravity, and the intermixing is repeated before the gas and the liquid have separated, so that the gas is substantially absorbed in the liquid, forming a gas-liquid solution of the predetermined concentration. The stream may be brought into turbulence for intensifying the intermixing of the gas and the liquid. An apparatus for performing the process includes a conduit including a continuous tubular coil formed with a plurality of upwardly and downwardly directed sections. Suitably, elements generating turbulence are disposed within the tubular coil, as is also a pressure-sustaining valve which maintains a predetermined overpressure in the conduit is provided. Suitably, the tubular coil is shaped as a horizontal helix.

17 Claims, 1 Drawing Sheet

U.S. PATENT DOCUMENTS

| | | | | |
|---|---|---|---|---|
| 847,552 | A * | 3/1907 | Carlson | 261/111 |
| 3,487,621 | A * | 1/1970 | Bichet et al. | 96/236 |
| 5,493,743 | A * | 2/1996 | Schneider et al. | 8/149.2 |
| 6,158,721 | A | 12/2000 | Katou et al. | |
| 6,254,838 | B1 * | 7/2001 | Goede | 422/186.12 |
| 6,346,198 | B1 | 2/2002 | Watson et al. | |
| 6,464,210 | B1 * | 10/2002 | Teran et al. | 261/79.2 |
| 6,955,341 | B2 * | 10/2005 | Liou | 261/64.1 |
| 2003/0146523 | A1 * | 8/2003 | Morse et al. | 261/79.2 |

FOREIGN PATENT DOCUMENTS

| | | | |
|---|---|---|---|
| RU | 2085269 | C1 | 7/1997 |
| SU | 1042782 | A1 | 9/1983 |

* cited by examiner

METHOD FOR THE ABSORPTION OF A GAS IN A LIQUID AND AN APPARATUS FOR THIS

This application is a 371 of PCT/FI2004/000767, filed Dec. 16, 2004.

BACKGROUND

1. Field

Disclosed herein is a process for producing a solution of a gas in a liquid in which the gas is soluble, the solution having a predetermined concentration up to saturation, and to apparatus therefor.

2. Description of Related Art

Dissolution of a gas in a liquid is generally called absorption and may take place in several known and common ways. The absorption can be performed in a tower, a so-called absorption tower, in which the gas flows in counterflow relation to a circulating liquid. It can also be performed by means of a liquid jet pump, the absorption taking place in the minute droplets formed in the jet of liquid. Several other techniques can also be employed, mostly in counterflow, so that the largest possible contact surface between gas and liquid is provided for the absorption.

Common to the known methods to accomplish absorption and to the existing absorption apparatus is their requirement for more or less continuous manual monitoring. These methods also require a system of components which may be large or complicated. This is undesirable if the process is to form part of a complex process, having regard to its effectiveness, space requirements, safety aspects, operational requirements and economy. It is often necessary to be able to perform the absorption within a wide interval of flow rates and to be able to select the concentration of the solution that is produced. It may also be necessary that the gas be almost completely absorbed by the liquid, so that there will be no need to take care of the sometimes poisonous or environmentally dangerous gas. Moreover, small dimensions may be called for to save space or in view of the materials used.

SUMMARY

Disclosed herein is a process and suitable apparatus for performing a controlled gas-liquid absorption without extensive monitoring of the process and at the same time essentially avoiding the disadvantages mentioned above.

In accordance with a particular embodiment, the gas and the liquid are brought together under controlled supply in a proportion corresponding to the predetermined concentration of the solution. The gas and the liquid are caused to form a stream passing through a common conduit. The gas and the liquid are caused to intermix under the action of gravity and the intermixing is repeated before there is time for the gas and the liquid to separate, so that the gas is substantially absorbed in the liquid, forming a gas-liquid solution of the predetermined concentration.

Preferably, the process is carried out such the stream is brought into turbulence for intensifying the intermixing of the gas and the liquid. Suitably, the mixing is carried out at a pressure above the atmospheric pressure.

The process disclosed herein is generally useful for any combination of gas and liquid, especially combinations in respect of which performing the absorption is complicated, such as when the solubility is low. However, the process is particularly suited for absorption of chlorine gas in water if what is required is a chlorine gas solution whose concentration is to be chosen within a wide range and which has a wide range of flow rates and where small dimensions of the apparatus is more or less a must in view of problems related to materials and environment concerns.

In a particular embodiment the apparatus described herein comprises a conduit including a continuous tubular coil formed with a plurality of upwardly and downwardly directed sections. Suitably, elements generating turbulence are disposed within the tubular coil, and preferably a pressure-sustaining valve is provided to maintain a predetermined overpressure in the conduit. At least the tubular coil is preferably installed in a protective pressure-proof enclosure. The tubular coil may suitably be provided with packing bodies and/or folds for intensifying the intermixing of the gas and the liquid. Suitably, the tubular coil is shaped as a horizontal helix of a length that may vary in accordance with the absorption process to be performed.

BRIEF DESCRIPTION OF THE DRAWINGS

The process and apparatus will now be described in greater detail with reference to the accompanying drawing, which illustrates but does not limit the principle of a preferred apparatus for performing the absorption.

DETAILED DESCRIPTION OF SPECIFIC EMBODIMENT

Figure 1:
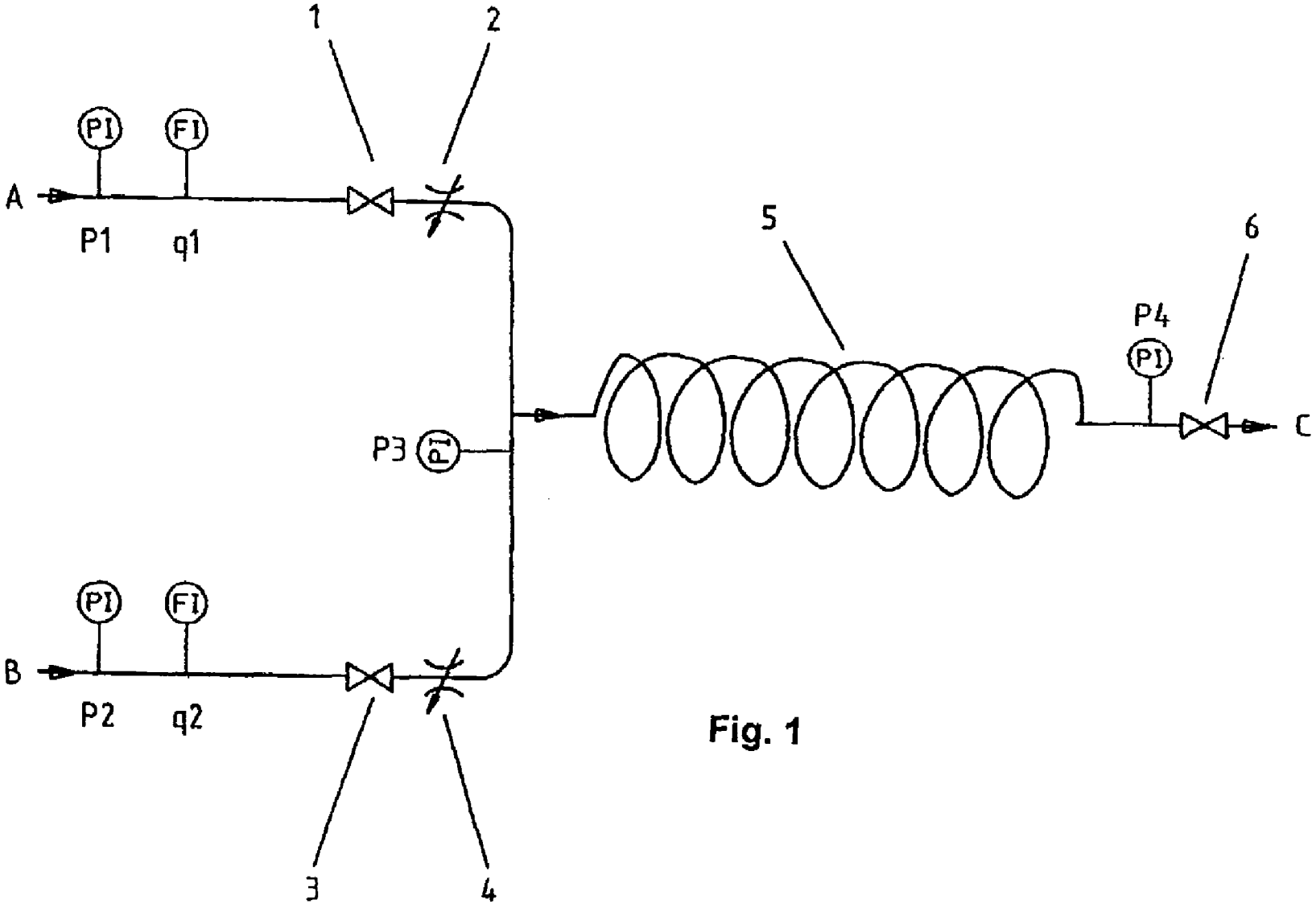

Absorption of a gas in a liquid takes place through a controlled supply of gas, such as chlorine gas, to a conduit A and of liquid, such as water, to a conduit B in a conduit system. During the course of the absorption, a constant proportion between the gas flow rate and the liquid flow rate can be maintained in the system by means of a restrictor device 2 for the gas and a restrictor device 4 for the liquid. Pressures can be measured in the system by means of a number of pressure indicators (P1), and the flow rates can be measured by means of a number of flow indicators (F1) in the conduits. The streams of gas and liquid meet, whereupon dispersive admixing of the gas with the liquid takes place and the liquid is caused to proceed in the system under a certain overpressure through a continuous tubular coil 5 formed with a plurality of upwardly and downwardly extending tubular parts, which form a horizontal helix or a similarly shaped structure. As the gas and the liquid proceed through the turns of the coil 5, they are repeatedly mixed so that a favourable contact area between the gas and the liquid is constantly maintained. To intensify the intermixing, the tubular coil 5 suitably is provided with elements, not shown in the drawing, such as folds, for causing turbulence in the flowing stream and thereby making the absorption more efficient. The number of turns of the tubular coil 5 may also be varied to optimize the absorption. Moreover, the tubular coil 5 may be provided with packing bodies, which favour the absorption so that a shorter tubular coil 5 can be used. An overpressure (P4) is maintained in the apparatus by means of a pressure-sustaining valve 6 to speed up the process. The gas-liquid mixture exits the conduit system through a connector C.

For safety reasons, it may be important to prevent reverse flow in the gas conduit A and in the liquid conduit B. To that end, ordinary check valves are not adequate, and it is preferred to monitor the pressures in these conduits. The condition to satisfy is that the pressures P1>P2>P3, and if that condition is not satisfied, the valves 1 and 3 are automatically closed to prevent reverse flow. It is also possible to monitor and control the flow rates $q_1$ and $q_2$ to prevent reverse flow.

The process and apparatus disclosed herein provides a number of important advantages in comparison with prior art processes. These advantages may be summarised as follows.

The absorption is effective within a wide range of flow rates because the intermixing of gas and liquid takes place only with the aid of gravity and is repeated for each turn of the coil, as contrasted with, for example, a static mixer or similar apparatus, where adequate turbulence is obtained only within a narrow range of flow rates.

The absorption can be made more efficient by means of folds or packing bodies in the tubular coil, which permit increased turbulence and improved contact between the gas and the liquid.

The absorption can also be speeded up by placing the system under a suitable predetermined overpressure. The expensive materials which are often required in corrosive environments, such as chlorine, call for a compact material-saving unit.

There is no need for separate disposal of gas, because the liquid flow rate is adjusted for dissolution of the gas.

When chlorine is processed, the system contains less chlorine than is otherwise possible, and thus less chlorinated water has to be processed. As a result, there is less danger of leakage and, accordingly, an improved environment and an improved personal safety.

There is no need for a circulating quantity of liquid, that is, there is only a "single" flow path.

A compact construction is possible, which permits the tubular coil and, possibly, the entire system to be housed in a pressure-proof enclosure if particularly stringent demands with respect to environment and safety have to be met.

The apparatus is believed to be less costly than existing systems, because its components and/or parts can have small dimensions.

The invention having been described by reference to certain specific embodiments, it will be recognized that the specific embodiments illustrate, and do not limit the scope of the appended claims.

The invention claimed is:

1. A process for producing a solution of a gas in a liquid in which the gas is soluble, the solution having a predetermined concentration of the gas up to saturation, the process comprising:

contacting the gas and the liquid in a proportion corresponding to the predetermined concentration of the solution and forming a stream of the gas and the liquid which passes through a common conduit comprising a continuous tubular coil formed with a plurality of upwardly and downwardly directed sections;

repeatedly intermixing the gas and liquid in the common conduit under the action of gravity before the gas and the liquid separate so that the gas is substantially absorbed in the liquid thereby forming the solution having the predetermined concentration.

2. The process of claim 1, further comprising subjecting the stream to turbulent flow, thereby intensifying the intermixing of the gas and the liquid.

3. The process of claim 2, wherein the intermixing is conducted at a pressure above atmospheric pressure.

4. The process of claim 3, wherein the gas comprises chlorine and the liquid comprises water.

5. The process of claim 1, wherein the intermixing is conducted at a pressure above atmospheric pressure.

6. The process of claim 5, wherein the gas comprises chlorine and the liquid comprises water.

7. The process of claim 1, wherein the gas comprises chlorine and the liquid comprises water.

8. An apparatus for conducting the process of claim 1, wherein the apparatus comprises a continuous tubular coil formed with a plurality of upwardly and downwardly directed tubular parts.

9. The apparatus of claim 8, wherein elements producing turbulence are provided in the continuous tubular coil.

10. The apparatus of claim 9, wherein a pressure sustaining valve which maintains a predetermined overpressure is located in the common conduit and the common conduit is connected to the continuous tubular coil.

11. The apparatus of claim 10, wherein at least the continuous tubular coil is installed in a protective pressure-proof enclosure.

12. The apparatus of claim 11, wherein the continuous tubular coil is provided with at least one of packing bodies and folds.

13. The apparatus of claim 11, wherein the continuous tubular coil is a horizontal helix.

14. The apparatus of claim 8, wherein a pressure sustaining valve which maintains a predetermined overpressure is located in the common conduit and the common conduit is connected to the continuous tubular coil.

15. The apparatus of claim 8, wherein at least the continuous tubular coil is installed in a protective pressure-proof enclosure.

16. The apparatus of claim 9, wherein the continuous tubular coil is provided with at least one of packing bodies and folds.

17. The apparatus of claim 8, wherein the continuous tubular coil is a horizontal helix.

* * * * *